US007976009B2

(12) United States Patent
Ruhk et al.

(10) Patent No.: US 7,976,009 B2
(45) Date of Patent: Jul. 12, 2011

(54) METHOD AND DEVICE OF CONTROLLING SHEETS IN A DIGITAL PRINTING MACHINE

(75) Inventors: Martin Ruhk, Schaalby (DE); Dieter Dobberstein, Melsdorf (DE); Uwe Weinlich, Monsheim (DE)

(73) Assignee: Eastman Kodak Company, Rochester, NY (US)

( * ) Notice: Subject to any disclaimer, the term of this patent is extended or adjusted under 35 U.S.C. 154(b) by 559 days.

(21) Appl. No.: 12/063,269

(22) PCT Filed: Aug. 4, 2006

(86) PCT No.: PCT/EP2006/007765

§ 371 (c)(1),
(2), (4) Date: Feb. 8, 2008

(87) PCT Pub. No.: WO2007/017213

PCT Pub. Date: Feb. 15, 2007

(65) Prior Publication Data

US 2010/0156041 A1 Jun. 24, 2010

(30) Foreign Application Priority Data

Aug. 11, 2005 (DE) ..... 10 2005 038 325

(51) Int. Cl.
*B65H 5/00* (2006.01)
*B65H 5/22* (2006.01)

(52) U.S. Cl. ..... 271/4.02; 271/4.03; 271/10.02; 271/10.03

(58) Field of Classification Search ..... 271/4.01, 271/4.02, 4.03, 10.01, 10.02, 10.03
See application file for complete search history.

(56) References Cited

U.S. PATENT DOCUMENTS

| | | | |
|---|---|---|---|
| 5,678,138 | A | 10/1997 | Kobayashi et al. |
| 6,029,041 | A | 2/2000 | Takano et al. |
| 6,047,148 | A | 4/2000 | Nagatani et al. |
| 6,076,821 | A | 6/2000 | Embry et al. |
| 6,343,202 | B1 | 1/2002 | Kimura |
| 6,381,441 | B1 | 4/2002 | Byeon et al. |

FOREIGN PATENT DOCUMENTS

| | | |
|---|---|---|
| DE | 10023828 | 3/2002 |
| DE | 10154499 | 5/2002 |
| DE | 10234629 | 2/2004 |
| EP | 0810485 | 12/1997 |

*Primary Examiner* — David H Bollinger
(74) *Attorney, Agent, or Firm* — Donna P. Suchy

(57) ABSTRACT

The invention relates to a method of controlling sheets in a digital printing machine, wherein the arrival of at least one sheet in a transport path is detected at least once at at least one marked location of said transport path to improve the control of the sheets themselves during the printing operation. This is achieved in that at least one signal having a countable pulse is generated, in that a freely selectable but then fixed start of these pulses is assigned to the position of at least one frame (occupiable field) of frames—into which the minimum of one transport path segment is divided—relative to said marked location, and in that the minimum of one sheet is controlled with the use of this pulse at at least one other marked location of the transport path.

20 Claims, 1 Drawing Sheet

METHOD AND DEVICE OF CONTROLLING SHEETS IN A DIGITAL PRINTING MACHINE

FIELD OF THE INVENTION

The invention relates to a method and a device of controlling sheets in a digital printing machine, wherein the arrival of at least one sheet, preferably each sheet, in a transport path is detected at least once at at least one marked location of said transport path.

BACKGROUND OF THE INVENTION

U.S. Pat. No. 5,678,138 discloses a device for controlling sheets in a printing machine comprising means, which are provided to detect the arrival of at least one sheet, preferably each sheet, in a transport path at least once at least one marked location of said transport path, wherein an arrangement for generating at least one signal having a countable pulse, whereby a freely selectable but then fixed start of these pulses is assigned to the position of at least one frame of frames into which the minimum of one transport path segment is divided—relative to said marked location, and whereby the minimum of one sheet is controlled with the use of this pulse at least one other marked location.

U.S. Pat. No. 6,343,202 discloses another imaging forming apparatus, wherein the first marked location corresponds to the location of the sensor and the other locations correspond the transfer positions of image.

DE-A-102 34 629 explains, referring to an electrophotographically operating printing machine—which will be described in detail for the sake of clarity, without, however, representing a restriction to such a type of digital printing machine—how sheets to be printed are fed by one or more feeders to a paper path or, in more general terms, to a transport path for printing material of any type. Several feeders or feeding units provide printing material—specifically of different formats, weights, materials or the like. This is of particular advantage, especially in the case of a digital printing machine, because a new image is created anyhow for each new page to be printed, and thus even mixed print jobs can be processed without problems, namely those, in which, for example, such an individual print job consists of pages of a brochure which are directly fed in successive order to the printing unit and, subsequently, optionally also to a finishing step, in which case, for example, the front and rear cover sheets may consist of a heavier-weight paper and the subsequent papers may consist of a lighter-weight paper and, in between, even films of plastic material with diagrams or the like may be printed. Such different printing materials are made available in different feeding units and are fed in a pre-selected order to the transport path.

A first transport path segment that starts at the feeding units may consist, for example, of rotating driven grip belts, between which sheets are transported. Thereafter, the sheets could be transferred to and placed onto a rotating driven transport belt and adhere there due to electrostatic forces. In most cases, this transport belt is a transparent web of plastic material and passes through a printing system, which, for color printing, may of course comprise several printing units. In electrophotographic printing, one latent toner image per color separation is transferred to the sheet. Thereafter, the sheet is transported to a fusing unit, in which the toner image is fused to the printing material, specifically melt-deposited there, and cooled. Considering the transport into and through the fixing unit, a change of the transport member could again occur. Only sheets to be printed on one side are then continued to be transported or ejected into a tray. After the fusing step, sheets to be printed on both sides are returned to pass the printing unit and are turned over via a transport path loop for continued printing. The reverse transport and the turn may take place at the same time, for example, in that, also on this transport path segment, grip belts are used which take an approximately helical course and, in so doing, rotate the sheets about their longitudinal axes by 180 degrees.

In particular, the transport belt passing through the printing system, said belt being frequently referred to as a web in electrophotography, is to be loaded with sheets to be printed, whereby the space between sheets is to be small enough to achieve the greatest possible throughput per unit of time, i.e., to ensure the highest possible printing output. On the other hand, minimum distances between successive sheets must be maintained. This applies to simplex-printing of only the front side of sheets, as well as to duplex-printing when the front and rear sides of the sheets are printed and perfected.

In order to achieve an optimal or matched loading of the web, the web is divided virtually, or also by means of controllers, into areas which can be described as frames, in which respectively one sheet—taking into consideration common formats—is to be precisely placed for printing. In so doing, an area of the web is recessed, said area optionally having a transverse seam, by means of which the ends of the web are connected in order to form a closed loop. Usually, for convenience, this seam is also used as a mark that is detected by a sensor in order to allow a control of the rotary position of the web and to have a reference point. Therefore, this seam must not be covered by a sheet. Other marks could also be taken into consideration, in particular those which are applied only along the edge of the web.

To ensure, even in duplex-printing mode, that these frames on the transport belt will be exactly met again after the return transport of the sheets in order for the sheets to be transferred, the ratio of the running time of the sheets rotating via the return after the first side has been printed with respect to the running time of the web must represent a whole number.

However, despite this, problems may still occur in that sheet running times inside the considered printing machine are affected by various parameters. For example, the weight of the paper and the length of the paper have been found to represent dominant paper variables. Likewise, machine-specific parameters such as, for example, exact transport path length, roller diameter and motor speeds are contributing factors.

This behavior is the reason for various problems (e.g., image quality, insufficient distance between paper sheets) that occur when the machine is running. This is particularly noticeable when mixed paper print jobs are run. For example, thick (heavy) sheets have shorter running times than thin sheets. Consequently, during their run through the machine, the distance between two successive sheets can decrease distinctly (the fast, thick one catches up), this leading to an interruption of the printing function due to too small a distance between the sheets and hence to a clear loss of machine performance. Likewise, sheets could be deposited on the web seam and thus trigger image errors.

Therefore, the cited DE-A-102 34 629 suggests that a starting point for feeding a sheet from any, or the only, feeding unit is selected with respect to the type of printing material of which said sheet consists.

In this reference, advantageously, sheets are started depending on the type—specifically their length and/or weight—at different times, i.e., fed by the respective feeding unit to the transport path, in order to apply a counter-error to potentially (even with respect to each other) skewed sheets as expected during transport for correction at the onset, so that the desired position will be taken during transport. In order to be able to perform such a preliminary control in a quantitatively targeted manner, a development in this case provides that information for the selection of the starting time is yielded beforehand by at least one trial run with at least one type of printing material, preferably by trial runs with different types of material, while a corresponding empirical table is created, for example, configured as a look-up table, i.e., a specified table.

However, it has been found that the generation and use of such tables is very complex and still does not always provide fully satisfactory results.

The object of the invention is to show a possibility of improving the control of the sheets themselves during the printing operation.

SUMMARY OF THE INVENTION

The invention relates to a method of controlling sheets in a digital printing machine, wherein the arrival of at least one sheet in a transport path is detected at least once at least one marked location of said transport path.

The object of the invention is to show a possibility of improving the control of the sheets themselves during the printing operation. This object is achieved in that at least one signal having a countable pulse is generated, in that a freely selectable but then fixed start of these pulses is assigned to the position of at least one frame (occupiable field) of frames—into which the minimum of one transport path segment is divided—relative to said marked location, and in that the minimum of one sheet is controlled with the use of this pulse at least one other marked location of the transport path.

DETAILED DESCRIPTION OF THE INVENTION

Figure 1:
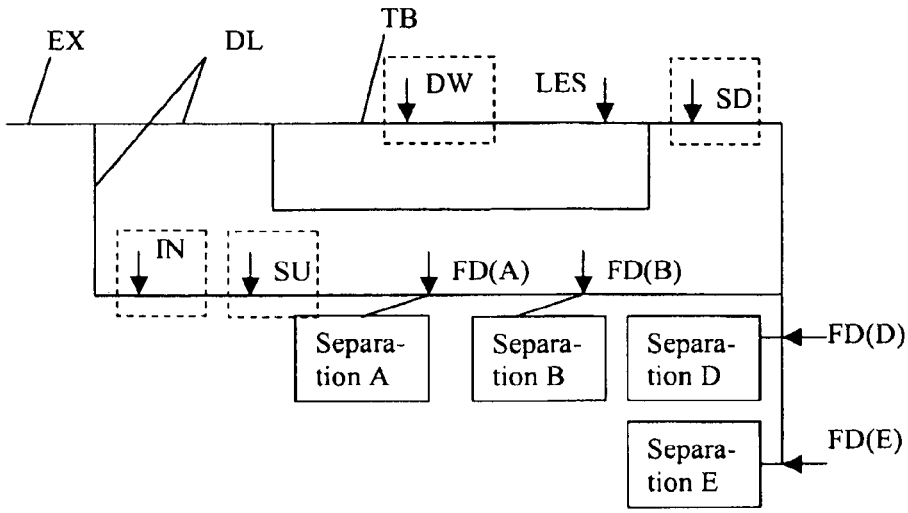
FIG. 1 shows a side elevation view of a transport path in a printer.

In accordance with the invention, this object is achieved in that at least one signal having a countable pulse is generated, in that a freely selectable but then fixed start of these pulses is assigned to the position of at least one frame (occupiable field) of frames—into which the minimum of one transport path segment is divided—relative to said marked location, and in that the minimum of one sheet is controlled with the use of this pulse at at least one other marked location of the transport path.

The arrival of a sheet, regardless of whether it comes from a feeder or whether it has already passed through a turnaround loop after having been printed, is usually controlled when said sheet is transferred to the aforementioned transport belt, before said sheet is optionally again fed to the printing mechanism, this requiring that a sheet be precisely positioned. Specifically, this means that the sheet is present at a predetermined time at this marked location during said sheet's transfer to the transport belt, said location being marked by the presence of a lead edge sensor for the detection of the lead edge of said sheet, and can be continued to be transported, so that, for example, the time of providing an imaging cylinder with a printing image and the time of transfer of this printing image to the sheet can be adjusted precisely to the time of arrival of the sheet at the lead edge sensor, taking into consideration the transport speed and the distance between the transfer location of the printing image and the lead edge sensor. Thus, for relative positioning of the sheet, the sheet's position can be changed, specifically the transport speed can be changed, or the time of applying the image of the printing image can be changed, in which case, following the arrival of the sheet at the lead edge sensor, i.e., at said marked location of the transport path, it is preferred in an electrophotographically operating digital printing machine to perhaps still change the imaging time thereafter, because the sheet is to be fixed in position on the transport belt, for example, electrostatically, and the transport belt is to rotate as uniformly as possible. However, the imaging time can also be changed only if absolutely necessary and to a very small extent in order that the overall printing process, i.e., the succession of many sheets, will not be impaired too much. Therefore, it is important that the sheet arrive as closely as possible to a predetermined time at said marked location, namely at the lead edge sensor.

As already mentioned, this point in time must be determined by taking into consideration the transport speed of the transport belt and the distance between the lead edge sensor and the transfer location of the printing unit, in which case the sheet too must of course be placed correctly as specified in one of said frames of the transport belt. Therefore, the frame specified for the sheet must also be available, or must arrive at the lead edge sensor, at the predetermined time in a time-appropriate and exact position to take over the sheet. Thus, the arrival times of the sheet and of the frame must be adjusted relative to each, these arrival times preferably being the same.

In order to ensure this precision, the invention provides that the sheet is controlled at least once upstream of the lead edge sensor in order to intervene, if necessary, in a controlling manner in the transport of the sheet, in particular, by temporarily accelerating or decelerating the sheet. To achieve this, the invention advantageously provides a control option, by means of which the time of arrival of the sheet at the additional control point is related to the time of arrival of the associated frame at the lead edge sensor or to the arrival of the sheet at that point. To achieve this, the invention provides that a clock signal is started on time, i.e., for example, before the respective sheet has moved from the feeder into the transport path, whereby this starting time is at a defined time interval from the time of arrival of the associated frame, for which this signal was started, at the lead edge sensor. Consequently, the number of clock pulses, after which the precisely assigned frame will arrive at the marked location, and thus also when the associated sheet will have to arrive at that location, is known.

The status of this counter is then transmitted to the control point or is known at the control point, so that, on arrival of the sheet at said control point—taking into consideration the distance of the control point from the marked location and the intended transport speed—it is possible to detect whether or not the sheet is approximately on schedule and whether, for example, something should be temporarily changed regarding the intended transport speed in order to bring the sheet to the marked location as scheduled. The additional control point too may be marked, for example, by a (separate) lead edge sensor, and comprise devices for the timing signal and potentially comprise a controller.

In particular, a modification of the inventive method is characterized in that individual control elements operate independently of each other, in that each of said control elements generates a countable pulse, in that the time of desired arrival of the sheet to be controlled at said element corresponds to a counting value of said pulse which, taking into consideration the position of this control element in the transport path, is adjusted to a central clock pulse for the position of the frame associated with this sheet that is to be controlled, and in that each control element comprises a sensor for the detection of the actual arrival of this sheet that is to be controlled. Specifically, this development makes a synchronization with a central "clock" in the printing machine—which would be technically difficult to implement—unnecessary because each of the control elements is advantageously self-sufficient and needs to receive only the clock pulse associated with the respective frame.

In accordance with the invention, the position of the sheet, said position being directly independent of the positions of previous and successive sheets, is advantageously determined relative to at least one frame, and said position is used for comparison with a desired position of said sheet. Thus an "absolute" determination is made for each sheet as to whether said sheet is on schedule.

As already mentioned, if necessary, the position of the respective sheet is corrected based on the comparison of an actual value with a planned or set value, in which case, for the correction of the position of the sheet, preferably at least one change of the sheet's transport speed is performed, whereby this change can be achieved at a specified location within the transport path; however, preferably, several such locations may also be provided along the transport path, said locations being provided with appropriate control elements for velocity changes.

As already indicated, the position of the respective control element in the transport path is determined beforehand, preferably by way of calibration, as the running time of a sheet, i.e., in particular the (time) interval between one control point and the last control point, preferably the transfer to the transport belt, in order to adjust the position of a frame.

In order to achieve sufficient accuracy during clock pulse processing and, in particular, to make pulse leading edges insignificant, a clock pulse interval of 100 micro-seconds is preferably selected.

As already explained several times, a preferred embodiment of the invention provides that, at least for one transport path segment, a continuously rotating transport belt is used, said segment being divided into a whole number of frames, whereby, preferably, a seam rotating with the transport belt or an otherwise marked location of the transport belt is used as the reference point for the occupiable field or frame division, and the movement of this seam or this otherwise marked location on the transport belt past a sensor is used as the reference point for the clock signal. Also, the length of a duplex loop of the transport path is divided for duplex printing of a sheet into preferably a whole number of frames, said number being in an integral relationship with the whole number of frames of the transport belt.

Also, independent protection is claimed for an inventive device for carrying out the inventive method.

Hereinafter, referring to drawings, an embodiment each of the inventive method and an inventive device is explained, without restricting the scope of the invention to this embodiment.

BRIEF DESCRIPTION OF THE DRAWINGS

FIG. 1 shows a side elevation view of a transport path in a printer.

Figure 2:
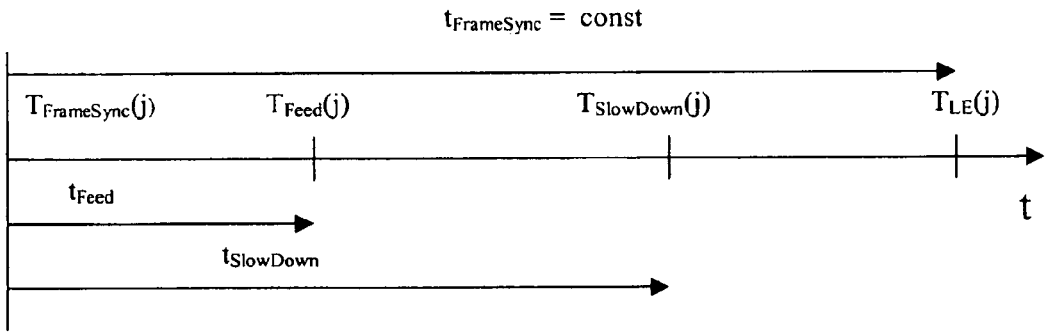
FIG. 2 shows a schematic of the transport of a sheet in the present invention.

FIG. 2 shows a schematic of the transport of a sheet in the present invention.

Figure 3:
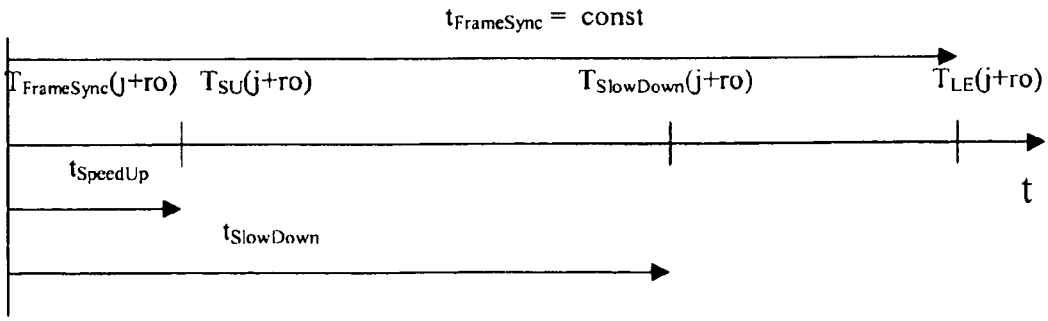
FIG. 3 shows a schematic of the transport of a sheet in the present invention.

FIG. 3 shows a schematic of the transport of a sheet in the present invention.

FIG. 1 shows a highly schematic and simplified side elevation of a transport path in a digital printing machine.

As already described, the lead edge "LE (n,s)" of pages "s" of a sheet "n" is to be placed on a pre-specified position on a transport belt "TB". This pre-specified position is defined as a time-specific distance before the arrival signal of a seam of the transport belt (seam signal). This seam signal, as well as the lead edges LE (n,s) of a sheet, are measured at the position "LES" with the use of a sensor (lead edge sensor). The transport from sheet feeders (separation A through separation E) to this position "LES" on the transport belt "TB" does not occur at a constant speed (or within a specific time) but varies from sheet to sheet by a not previously determinable deviation, for example, as already mentioned, due to different paper weight. The inventive method described here is to allow placement of the lead edges LE (n,s) on the pre-specified positions in associated occupiable fields or frames on the transport belt "TB" in the position "LES" in a time-appropriate manner.

With the use of a sensor, which detects the seam of the transport belt, for example, with the use of the lead edge sensor "LES", the time of rotation "$T_{web}$" of the transport belt "TB" is determined. This time of rotation correlates with the length "$I_{Web}$" of the transport belt (web), as expressed by the following formula (1):

$$I_{Web}=v_{Web}*t_{Web} \tag{1}$$

wherein:

$t_{Web}$ time of rotation of the transport belt $v_{Web}$ mean speed (process speed of the transport belt)

$I_{Web}$ length of the transport belt

The transport belt is divided into a number "k" of equally large frames or occupiable fields. The lead edges LE (n,s) of the sheets are respectively placed on the start of a frame at the position of the lead edge sensor "LES". The time $T_{LE}(j)$, at which the lead edge LE (n,s) of a sheet "n" is to be placed in the frame "j" at the position "LES", is calculated as the time-specific distance (offset) from the point in time of the seam signal "$T_{Seam}(u)$" of one rotation "u" of the transport belt (new for each rotation "u"), as expressed by the following formula (2):

$$T_{LE}(j)=T_{Seam}(u)+j*(t_{Web}/k) \tag{2}$$

wherein:

K the number of frames on the transport belt, and u the $u^{th}$ rotation of the transport belt.

A scheduling algorithm is designed for determining the feed control and the times for assigning the lead edges LE (n,s), so that the following formula (3) applies:

$$T_{LE}(n,0)=T_{LE}(j) \text{ and}$$

$$T_{LE}(n,1)=T_{LE}(j+ro) \tag{3}$$

In so doing, the front side of a sheet "n" is set to "0" and a rear side to "1", and "ro" represents a constant frame offset between the frames for the front side and the frames for the rear side of the sheet "n"; and "ro" is a function of the ratio of the lengths and speeds of the transport belt "TB" and the remaining transport path, specifically in case of a duplex loop "DL", along which a sheet is returned after passing at least one printing unit "DW" and having been turned over in an inverting arrangement (inverter) "IN", said inverting arrangement finally ejecting said sheet into an output tray "EX".

In order to create a common time base for all the units participating in the transport of the sheet, the scheduling algorithm generates a synchronization signal. "Frame Sync"

at a basically random but then fixed starting point "$T_{FrameSync}$(j)" for the respective frame "j". Thus, the synchronization signal "Frame Sync" defines, at the time "$T_{FrameSync}$(j)", a constant time offset "$t_{FrameSync}$" prior to time "$T_{LE}$(j)". The only requirement is that the synchronization signal be generated prior to the first use by one of the signal-processing units.

Within the printing machine, there are identified or marked positions (FD(A . . . E), SD, SU, LES), for which the times "$T_{Feed(A \ldots E)}$, $T_{SlowDown}$, $T_{SpeedUp}$, $T_{LE}$" have been defined. For example, "FD" represents the feeding of a sheet by the feeder, and "SD" and "SU" represent the decelerating arrangements and the accelerating arrangements for changing the velocity of the transport speed of a respective sheet, and, if necessary, for correcting said sheet's position. The positions or locations in the transport path identified or marked in this way have suitable control elements comprising sensors and signal-processing arrangements.

Consequently, referring to the front page of a sheet, critical times or points in time are obtained, said times having the descriptions chosen above, as marked in sequence on a timeline (t) as in FIG. 2.

Referring to the rear side of the sheet, critical times or points in time are obtained, said times having the descriptions chosen above, as marked in sequence on a timeline (t) as in FIG. 3.

The time "$T_{Feed}$(j)", at which a sheet feeder (separation A . . . separation E) must place a sheet "n" in position "FD(A . . . E)" so that its lead edge LE (n,s) reaches the position "LES" at the time "$T_{LE}$(j)", is determined by a calibration of all essential points in time, starting with the rear page times mentioned in FIG. 3, regarding their nominal time offset. In so doing, for the sake of completeness, it is pointed out that, for example, length changes of the transport belt advantageously need not be calibrated in conjunction with the inventive method, because the seam signal is actually newly determined for each rotation "u".

In contrast, the time "$T_{SlowDown}$(j)", at which the lead edge LE (n,s) must have reached the position "SD", is determined by calibration, as is the time "$T_{speedUp}$(j)", at which the lead edge LE (n,1) must have reached the position "SU".

Within the printing machine, mutually independent signal processing units "separation (A . . . E)", "SD" (SlowDown) and "SU" (SpeedUp) can be used to vary the transport speed by deceleration or acceleration. These units, upon receiving the synchronization signal "$T_{FrameSync}$(j)", store the value of a counter that runs freely at 10 kHz. These units comprise sensors at one of the positions "FD(A . . . E), SD, SU" in order to detect the times "$T_{LEFeed}$, $T_{LESlowDown}$, $T_{LESpeedUp}$" of the arrival of the lead edge "LE (n,s)" of the associated sheet "n". By simply using the difference with respect to the scheduled times, the time of the error position "$t_{Fehl}$" of the lead edge is determined by the following formula (4):

$$t_{Fehl}=T_{LExx}-T_{xx} \tag{4}$$

wherein: "XX" represents one of the marked positions.

A correction by time "$t_{Fehl}$" must be made in the control elements.

The signal-processing units are not able to process absolute points in time "T", because there is no synchronized systems clock. All time values can be processed only as relative times "t". To achieve this, upon receipt of the synchronization signal "FrameSync(j)" at the time "$T_{FrameSync}$(j)", the actual value per unit is stored by a freely running 10 kHz counter. Upon detection of the lead edge of an associated sheet "n", the actual value of the same 10 kHz counter is read out again. These values are used to determine the difference as expressed by equation (4).

The clock frequency of 10 kHz was selected in such a manner that errors due to the acceptance of signal edges may be neglected. The pulse generation is sufficiently accurate, so that errors due to different frequencies between units may be neglected.

The invention claimed is:

1. A method of controlling sheets in a digital printing machine, comprising:

detecting the arrival of a sheet in a transport path at a first location of said transport path, determining a first state of at least one signal having a countable pulse when the sheet is detected at the first location;

detecting the arrival of reference on a transfer belt at a first marked location;

determining a first number of countable pulses after which the position of at least one frame, comprising an occupiable field of a plurality of frames on a transport belt that has a known position relative to said reference will arrive at the marked location;

adjusting movement of the sheet through the transport path by a first comparison of a difference between the initial state of the counter and determined number of countable pulses associated with the first location;

determining a second state of at least one signal having a countable pulse when the sheet is detected at a second marked location in the transport path;

determining a second number of countable pulses after which the position of the at least one frame will arrive at the marked location;

adjusting further movement of the sheet through the transport path toward the marked location by a second comparison of a difference between the second state and the number of countable pulses with a predetermined number of countable pulses associated with the second location;

wherein sheet is moved so that the sheet feeds onto the transport belt aligned with the frame.

2. The method of claim 1, wherein the movement of the sheet is corrected based on the first comparison.

3. The method of claim 1 wherein at the first marked location along the transport path movement of the sheet is adjusted by increasing the transport speed of the sheet and at the second marked location along the transport path movement of the sheet is adjusted by slowing down the transport speed of the sheet.

4. The method of claim 3, further comprising determining an additional state of the counter at an additional marked location with said at least one additional location determining an additional number of countable pulses after which the position of the frame will be located at the transfer point and further controlling the movement of the sheet as necessary to cause the sheet to reach the transfer point in with the frame.

5. The method of claim 4, wherein separate determinations are made as to how to control the movement of the sheet at each of the marking locations taking into consideration the position of each marking location in the transport path.

6. The method of claim 5, wherein each marked location is associated with a number of counter pulses determined beforehand, by way of calibration, as the running time of a sheet, for comparison in determining how to adjust the movement of the sheet.

7. The method of claim 1, wherein a clock pulse interval of 100 micro-seconds is selected.

8. The method of claim 1, wherein the transport belt is a continuously rotating transport belt is used said belt being divided into a whole number of frames.

9. The method of claim 8, wherein a seam rotating with the transport belt or an otherwise marked location of the transport belt is used as the reference for the division of the occupiable field or frame, and the movement of this seam or this otherwise marked location on the transport belt past a sensor is used as the reference point for the clock signal.

10. The method of claim 8, wherein the length of a duplex loop of the transport path is divided for duplex printing of a sheet into a whole number of frames, said number being in an integral relationship with the whole number of frames of the transport belt.

11. A device for controlling sheets in a digital printing machine comprising:

a first sensor that is adapted to detect the arrival of at least one sheet in a first marked location of a transport path a belt sensor that is adapted and positioned to detect when a reference on a transport belt reaches a transfer point at which a sheet transfer from the transport path onto the belt;

a signal generator that is configured to generate at least one signal having a countable pulse; and a controller configured to determine a first number of countable pulses after which the position of a frame comprising an occupiable field of the transport belt and that has a known position relative to the reference will be located at the transfer point and to control a first actuator that influences the movement of the sheet based upon the the first number of pulses;

a second sensor that is adapted to detect the arrival of at least one sheet in a second marked location of the transport path, wherein the controller is further configured to determine a second number of countable pulses after which the position of the frame will be located at the transfer point and to control a second actuator that influences movement of the sheet based upon the second number of pulses so that the sheet will reach the transfer point in concert with the frame.

12. The device of claim 11, wherein the first actuator is operated to adjust movement of the first sheet is based on the comparison.

13. The device of claim 11, wherein movement of the sheet at the first location along the transport path is provided for speeding up the transport speed of the sheet and movement of the sheet at the second location along the transport path is provided for slowing down the transport speed of the sheet.

14. The device of claim 11, wherein at least one additional marked location is provided along the transport path, said each marked locations being provided with an additional sensor from which the arrival of the sheet at the marked location can be determined, and an additional actuator that can influence the movement of a sheet is provided, and wherein the controller is further adapted to cause determine further configured to determine an additional number of countable pulses after which the position of the frame will be located at the transfer point and to control the additional actuator so that the additional actuator influences movement of the sheet based upon the additional number of pulses so that the sheet will reach the transfer point in concert with the frame.

15. The device of claim 11, wherein the controller comprises a plurality of individual control elements with one for each marked location, and wherein the individual control elements operate independently of each other, that each of said control elements generates a countable pulse, that the time of desired arrival of the sheet to be controlled at this control element corresponds to a counting value of said pulse which, taking into consideration the position of this control element in the transport path, is adjusted to a central clock signal for the position of the frame associated with this sheet that is to be controlled, and that each control element comprises a sensor for the detection of the actual arrival of this sheet that is to be controlled.

16. The device of claim 15, wherein the each marked location is associated with a number of counter pulses determined beforehand, by way of calibration, as the running time of a sheet, for comparison in determining how to influence the movement of the sheet to so that the sheet reaches the transfer point in concert with the frame.

17. The device of claim 11, wherein a clock pulse interval of 100 micro-seconds is selected.

18. The device of claim 11, wherein the transport belt is a continuously rotating transport belt, with the belt being divided into a whole number of frames.

19. The device of claim 11, wherein a seam rotating with the transport belt or an otherwise marked location of the transport belt is used as the reference for location of the frame, and the movement of this seam or this otherwise marked location on the transport belt past a sensor is used as the reference point for the clock signal.

20. The method of claim 11, wherein the length of a duplex loop of the transport path is divided for duplex printing of a sheet into a whole number of frames, said number being in an integral relationship with the whole number of frames of the transport belt.

* * * * *